US009595759B2

(12) United States Patent
Oh et al.

(10) Patent No.: US 9,595,759 B2
(45) Date of Patent: Mar. 14, 2017

(54) SINGLE ELEMENT DUAL-FEED ANTENNAS AND AN ELECTRONIC DEVICE INCLUDING THE SAME

(71) Applicant: Nvidia Corporation, Santa Clara, CA (US)

(72) Inventors: Sung Hoon Oh, Santa Clara, CA (US); Joselito Gavilan, Santa Clara, CA (US); Warren Lee, Santa Clara, CA (US)

(73) Assignee: Nvidia Corporation, Santa Clara, CA (US)

( * ) Notice: Subject to any disclaimer, the term of this patent is extended or adjusted under 35 U.S.C. 154(b) by 128 days.

(21) Appl. No.: 14/160,277

(22) Filed: Jan. 21, 2014

(65) Prior Publication Data

US 2015/0207228 A1 Jul. 23, 2015

(51) Int. Cl.

| | |
|---|---|
| ***H01Q 7/00*** | (2006.01) |
| ***H01Q 5/35*** | (2015.01) |
| ***H01Q 1/24*** | (2006.01) |
| ***H01Q 9/42*** | (2006.01) |

(52) U.S. Cl.

CPC ..... *H01Q 5/35* (2015.01); *H01Q 1/243* (2013.01); *H01Q 7/00* (2013.01); *H01Q 9/42* (2013.01)

(58) Field of Classification Search

CPC .. H01Q 5/35; H01Q 7/10; H01Q 1/48; H01Q 1/243; H01Q 5/20; H01Q 21/28; H01Q 5/40

IPC ..... H01Q 5/35,7/10, 1/48, 1/243, 5/20, 21/28, 5/40

See application file for complete search history.

(56) References Cited

U.S. PATENT DOCUMENTS

| | | | |
|---|---|---|---|
| 4,125,810 | A | 11/1978 | Pavio |
| 5,861,854 | A | 1/1999 | Kawahata et al. |
| 6,229,487 | B1 | 5/2001 | Sadler et al. |
| 6,476,769 | B1 | 11/2002 | Lehtola |
| 6,911,940 | B2 | 6/2005 | Poilasne et al. |
| 7,091,908 | B2 | 8/2006 | Fabrega-Sanchez |
| 7,362,286 | B2 | 4/2008 | Fang |

(Continued)

FOREIGN PATENT DOCUMENTS

| | | |
|---|---|---|
| CN | 101106211 A | 1/2008 |
| CN | 101442151 A | 5/2009 |

(Continued)

OTHER PUBLICATIONS

Oh, Sung Hoon, et al., U.S. Appl. No. 14/159,880, filed Jan. 21, 2014, entitled "Wideband Antenna and An Electronic Device Including the Same".

(Continued)

*Primary Examiner* — Dameon E Levi
*Assistant Examiner* — Andrea Lindgren Baltzell

(57) ABSTRACT

Provided is an antenna. The antenna, in this aspect, includes an inverted-F GPS antenna structure, the inverted-F GPS antenna structure embodying a GPS feed element, a GPS extending arm, and a ground element. The antenna, in this aspect, further includes a loop WiFi antenna structure, the loop WiFi antenna structure embodying a WiFi feed element, the ground element, and a WiFi connecting arm coupling the WiFi feed element to the ground element. In this particular aspect, the ground element is located between the GPS feed element and the WiFi feed element.

20 Claims, 2 Drawing Sheets

(56) References Cited

U.S. PATENT DOCUMENTS

| | | | | |
|---|---|---|---|---|
| 7,551,142 | B1 | 6/2009 | Zhang et al. | |
| 7,696,928 | B2 | 4/2010 | Rowell | |
| 8,421,682 | B2 | 4/2013 | Nielsen et al. | |
| 8,648,752 | B2 | 2/2014 | Ramachandran et al. | |
| 8,665,164 | B2 | 3/2014 | Hill et al. | |
| 8,698,673 | B2 | 4/2014 | Wong et al. | |
| 8,766,859 | B2 | 7/2014 | Merz et al. | |
| 8,779,999 | B2 | 7/2014 | Gummalla | |
| 8,836,587 | B2 | 9/2014 | Darnell et al. | |
| 8,957,827 | B1 | 2/2015 | Lee et al. | |
| 2002/0146909 | A1 | 10/2002 | Yang et al. | |
| 2004/0252061 | A1 | 12/2004 | Vance | |
| 2006/0082506 | A1 | 4/2006 | Fang | |
| 2006/0139211 | A1 | 6/2006 | Vance et al. | |
| 2006/0208950 | A1 | 9/2006 | Tago | |
| 2007/0182658 | A1 | 8/2007 | Ozden | |
| 2008/0106478 | A1 | 5/2008 | Hill | |
| 2008/0231521 | A1 | 9/2008 | Anguera Pros et al. | |
| 2010/0033380 | A1 | 2/2010 | Pascolini et al. | |
| 2010/0271264 | A1 | 10/2010 | Li et al. | |
| 2010/0321255 | A1 | 12/2010 | Kough et al. | |
| 2011/0001675 | A1* | 1/2011 | Lee | H01Q 1/243 343/729 |
| 2011/0260938 | A1 | 10/2011 | Xie | |
| 2012/0046002 | A1 | 2/2012 | Hill et al. | |
| 2012/0154223 | A1 | 6/2012 | Oh et al. | |
| 2012/0173754 | A1 | 7/2012 | Dalrymple et al. | |
| 2012/0214412 | A1* | 8/2012 | Schlub | G01B 7/023 455/41.1 |
| 2012/0249393 | A1 | 10/2012 | Hotta et al. | |
| 2012/0299785 | A1 | 11/2012 | Bevelacqua | |
| 2013/0050057 | A1 | 2/2013 | Hayashi et al. | |
| 2013/0069836 | A1 | 3/2013 | Bungo | |
| 2013/0135156 | A1 | 5/2013 | Tsai et al. | |
| 2013/0222186 | A1* | 8/2013 | Leung | H01Q 1/521 343/700 MS |
| 2014/0118194 | A1 | 5/2014 | Gavilan et al. | |
| 2014/0118204 | A1 | 5/2014 | Gavilan et al. | |
| 2014/0141731 | A1 | 5/2014 | Abudul-Gaffoor et al. | |
| 2014/0159989 | A1 | 6/2014 | Malek et al. | |
| 2014/0232612 | A1 | 8/2014 | Jenwatanavet | |
| 2014/0266938 | A1 | 9/2014 | Ouyang et al. | |
| 2014/0368398 | A1 | 12/2014 | Ying | |
| 2015/0015445 | A1 | 1/2015 | Sanchez | |
| 2015/0022401 | A1 | 1/2015 | Gavilan et al. | |
| 2015/0022402 | A1 | 1/2015 | Gavilan et al. | |

FOREIGN PATENT DOCUMENTS

| | | | |
|---|---|---|---|
| CN | 201927704 | A | 8/2011 |
| DE | 69723366 | T2 | 4/2004 |
| DE | 102013017512 | A1 | 5/2014 |
| EP | 2405533 | A1 | 1/2012 |
| TW | 201101591 | A | 1/2011 |

OTHER PUBLICATIONS

Oh, Sung Hoon, et al., U.S. Appl. No. 14/160,036, filed Jan. 21, 2014, entitled "Wideband Loop Antenna and An Electronic Device Including the Same".

Oh, Sung Hoon, et al., U.S. Appl. No. 14/160,231, filed Jan. 21, 2014, entitled "Co-Located Antennas and An Electronic Device Including the Same".

* cited by examiner

SINGLE ELEMENT DUAL-FEED ANTENNAS AND AN ELECTRONIC DEVICE INCLUDING THE SAME

TECHNICAL FIELD

This application is directed, in general, to antennas and, more specifically, to single element dual-feed antennas for handheld electronic devices.

BACKGROUND

Handheld electronic devices are becoming increasingly popular. Examples of handheld devices include handheld computers, cellular telephones, media players, and hybrid devices that include the functionality of multiple devices of this type, among others.

Due in part to their mobile nature, handheld electronic devices are often provided with wireless communications capabilities. Handheld electronic devices may use long-range wireless communications to communicate with wireless base stations. For example, cellular telephones may communicate using 2G Global System for Mobile Communication (commonly referred to as GSM) frequency bands at about 850 MHz, 900 MHz, 1800 MHz, and 1900 MHz, among possible others. Communication is also possible in the 3G Universal Mobile Telecommunication System (commonly referred to as UMTS, and more recently HSPA+) and 4G Long Term Evolution (commonly referred to as LTE) frequency bands which range from 700 MHz to 3800 MHz. Furthermore, communications can operate on channels with variable bandwidths of 1.4 MHz to 20 MHz for LTE, as opposed to the fixed bandwidths of GSM (0.2 MHz) and UMTS (5 MHz). Handheld electronic devices may also use short-range wireless communications links. For example, handheld electronic devices may communicate using the WiFi® (IEEE 802.11) bands at about 2.4 GHz and 5 GHz, and the Bluetooth® band at about 2.4 GHz. Handheld devices with Global Positioning System (GPS) capabilities receive GPS signals at about 1575 MHz.

To satisfy consumer demand for small form factor wireless devices, manufacturers are continually striving to reduce the size of components that are used in these handheld electronic devices. For example, manufacturers have made attempts to miniaturize the antennas used in handheld electronic devices. Unfortunately, doing so within the confines of the wireless device package is challenging.

Accordingly, what is needed in the art is an antenna or antennas, and associated wireless handheld electronic device, which navigate the desires and problems associated with the foregoing.

SUMMARY

One aspect provides an antenna. The antenna, in this aspect, includes an inverted-F GPS antenna structure, the inverted-F GPS antenna structure embodying a GPS feed element, a GPS extending arm, and a ground element. The antenna, in this aspect, further includes a loop WiFi antenna structure, the loop WiFi antenna structure embodying a WiFi feed element, the ground element, and a WiFi connecting arm coupling the WiFi feed element to the ground element. In this particular aspect, the ground element is located between the GPS feed element and the WiFi feed element.

Another aspect provides an electronic device. The electronic device, in this aspect, includes storage and processing circuitry, input-output devices associated with the storage and processing circuitry, and wireless communications circuitry including an antenna. The antenna, in this aspect, includes: 1) an inverted-F GPS antenna structure, the inverted-F GPS antenna structure embodying a GPS feed element, a GPS extending arm, and a ground element, and 2) a loop WiFi antenna structure, the loop WiFi antenna structure embodying a WiFi feed element, the ground element, and a WiFi connecting arm coupling the WiFi feed element to the ground element, wherein the ground element is located between the GPS feed element and the WiFi feed element.

BRIEF DESCRIPTION

Reference is now made to the following descriptions taken in conjunction with the accompanying drawings, in which.

DETAILED DESCRIPTION

The present disclosure is based, at least in part, on the acknowledgment that current market trends in handheld electronic devices (e.g., smart phone and tablet designs) are moving toward thinner devices with larger displays and smaller bezels. Accordingly, smaller volumes are available for antenna integration in these new, smaller electronic devices.

With this acknowledgment in mind, the present disclosure recognized, for the first time, that by reducing the physical separation and size of the antennas by combining the GPS and WiFi antenna structures, the aforementioned volume constraints could be met. Specific to one embodiment of the disclosure, the GPS and WiFi antenna structures may be combined to share a common ground element. For example, the common ground element, in this embodiment, could be located between a feed element of the GPS antenna structure and a feed element of the WiFi antenna structure. Further to this embodiment, an extending arm of the GPS antenna structure could extend over at least a portion of the WiFi antenna structure.

By configuring the GPS antenna structure and WiFi antenna structure in the aforementioned manner, a highly isolated antenna system is achievable. Moreover, the typical costs associated with the manufacture of the separate GPS antenna structure and WiFi antenna structure are greatly reduced by combining the two antenna structures into a single conductive element. Moreover, the WiFi antenna structure can also function as a Bluetooth antenna structure.

Figure 1:
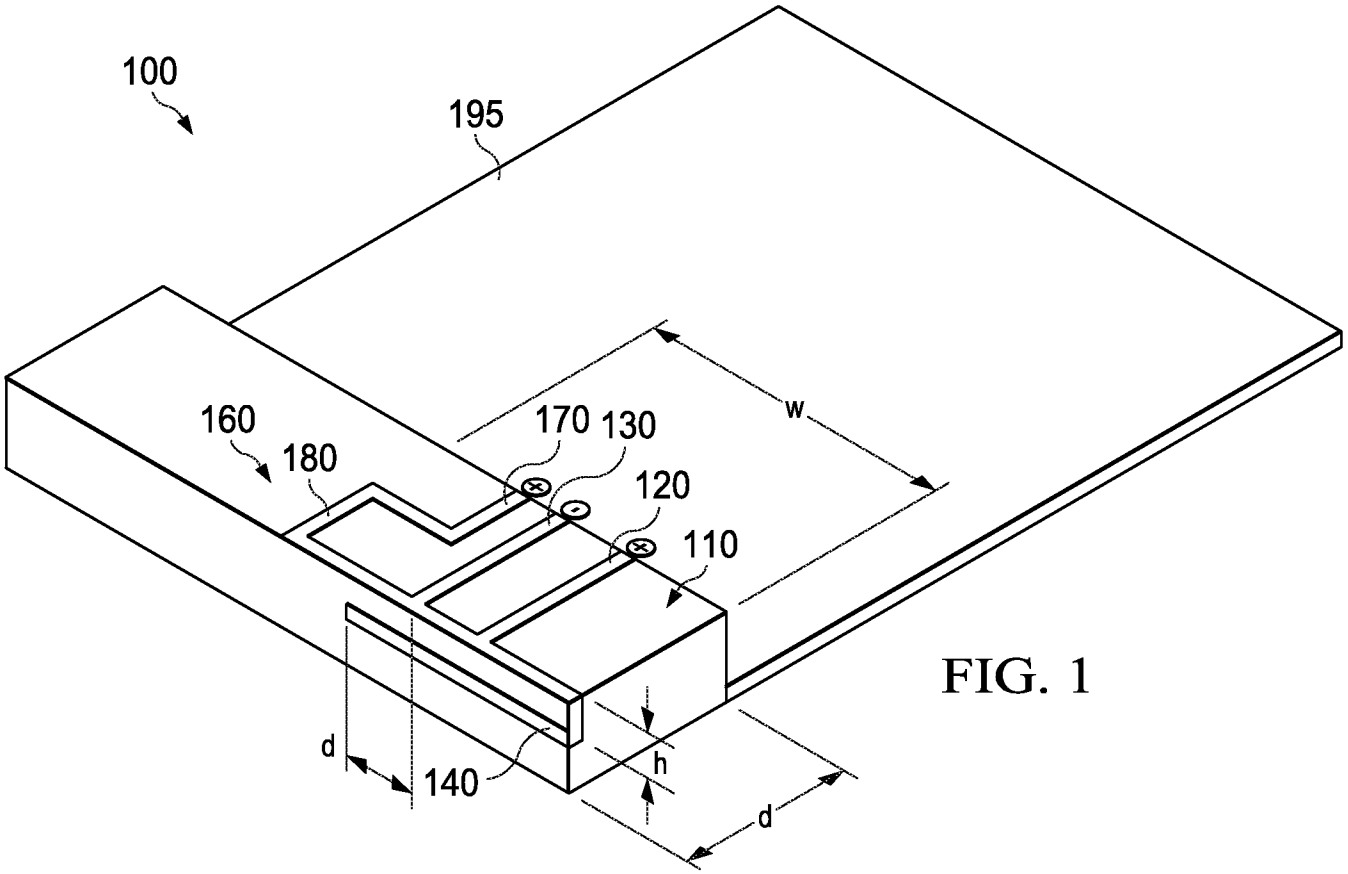
FIG. 1 illustrates antenna systems manufactured and designed according to embodiments of the disclosure.

Turning to FIG. 1, illustrated is an antenna 100 manufactured and designed according to one embodiment of the disclosure. The antenna 100, in the embodiment of FIG. 1, includes a GPS antenna structure 110. The GPS antenna structure 110, in accordance with the embodiment of FIG. 1, is an inverted-F GPS antenna structure. Accordingly, the GPS antenna structure 110 in the embodiment of FIG. 1 includes a GPS feed element 120 and a ground element 130. In accordance with one embodiment of the present disclosure, the GPS feed element 120 might directly connect to a positive terminal of a GPS transmission line (not shown), such as a coaxial cable, microstrip, etc., to receive radio frequency signals from associated transceivers. The ground element 130, in accordance with one embodiment, might electrically connect to a negative terminal of the GPS transmission line (not shown). Moreover, the ground element 130, in accordance with one embodiment of the disclosure, may connect to or form a portion of the conductive chassis 195.

The GPS antenna structure 110 further includes a GPS extending arm 140. The GPS extending arm 140, in accordance with one embodiment, is designed to set an operating frequency of the GPS antenna structure 110. In the embodiment of FIG. 1, the GPS extending arm 140 includes approximately three different sections. In this embodiment, major planes of the three different sections are all perpendicular to one another. This configuration, in one embodiment, is achievable by routing the GPS extending arm 140 elements along different perpendicular edges of the chassis 195. Other embodiments may exist wherein the different sections are not perpendicular to one another. The term "major plane", as used throughout this disclosure, refers to a plane created by the two largest dimensions of any given antenna section (e.g., height and width) as opposed to a plane created using the third smallest dimension of a given antenna section (e.g., the thickness).

The antenna system 100 illustrated in FIG. 1 further includes a WiFi antenna structure 160. The WiFi antenna structure 160, in the embodiment of FIG. 1, is configured as loop WiFi antenna structure. Accordingly, in the embodiment of FIG. 1 the WiFi antenna structure 160 includes a WiFi feed element 170 and the ground element 130. In accordance with one embodiment of the present disclosure, the WiFi feed element 170 might directly connect to a positive terminal of a WiFi transmission line (not shown), such as a coaxial cable, microstrip, etc., to receive radio frequency signals from associated transceivers. The ground element 130, which in the embodiment of FIG. 1 is shared between the GPS antenna structure 110 and the WiFi antenna structure 160, might electrically connect to a negative terminal of the WiFi transmission line (not shown).

The WiFi antenna structure 160 further includes a WiFi connecting arm 180. The WiFi connecting arm 180, in accordance with one embodiment, couples the WiFi feed element 170 and the ground element 130. Accordingly, the WiFi connecting arm 180 is designed to set an operating frequency of the WiFi antenna structure 160, for example by changing its relative length. In the embodiment of FIG. 1, the WiFi connecting arm 180 includes approximately three different sections. In this embodiment, major planes of the three different sections are all parallel to one another. This configuration, in one embodiment, is achievable by routing the WiFi connecting arm 180 elements along a same edge of the chassis 195. Other embodiments, however, may exist wherein one or more of the WiFi connecting arm 180 sections are on perpendicular edges of the chassis 195, thus making one or more of the major planes of the WiFi connecting arm 180 sections perpendicular to one another.

In accordance with one embodiment of the disclosure, the GPS antenna structure 110 and WiFi antenna structure 160 share a common ground element 130. In one embodiment, this requires that the ground element 130 be located between the GPS feed element 120 and the WiFi feed element 170. To help isolate the GPS antenna structure 110 and the WiFi antenna structure 160, in one embodiment the GPS extending arm 140 folds over at least a portion of the WiFi antenna structure 160. Particular to one embodiment of the disclosure, the GPS extending arm 140 folds over at least a portion of the WiFi connecting arm 180. For example, the GPS extending arm 140 might fold over the WiFi connecting arm 180 by a distance (d) of at least about 5 mm. In another embodiment, the GPS extending arm 140 might fold over the WiFi connecting arm 180 by a greater distance (d) of at least about 15 mm. The amount of overlap is important to help isolate the GPS antenna structure 110 and the WiFi antenna structure 160 from one another.

An antenna, such as the antenna 100 illustrated in FIG. 1, or many other antennas manufactured in accordance with the disclosure, may be configured to fit within existing antenna volumes. For instance, in one embodiment, the antenna 100 fits within an existing volume defined by a width (w), a height (h) and a depth (d). Such a volume, in many embodiments, forms the shape of a cube, as opposed to a more random volume. In accordance with one embodiment, the GPS antenna element 110 and WiFi antenna element 160 are configured to operate within a volume of less than about 1.5 $cm^3$. In yet another embodiment, the GPS antenna element 110 and WiFi antenna element 160 are configured to operate within a volume of less than about 1 $cm^3$, and in yet another embodiment less than about 0.5 $cm^3$. An antenna, such as the antenna 100 of FIG. 1, may be positioned along different edges of an electronic device and remain within the purview of the disclosure.

Figure 2:
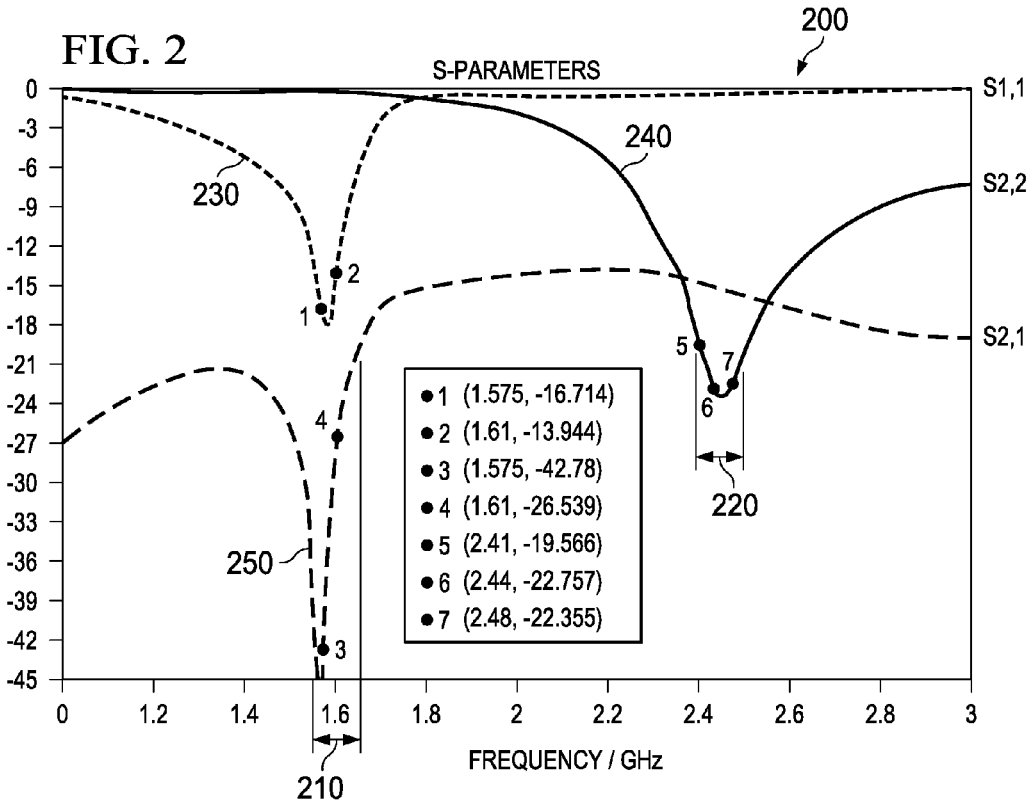
FIG. 2 illustrates an S-parameter plot for antenna systems in accordance with the present disclosure.

FIG. 2 illustrates an S-parameter plot 200 for an antenna system in accordance with the present disclosure. The S-parameter plot 200 might, in one embodiment, be representative of the antenna 100 of FIG. 1. Specifically, plot 200 illustrates the frequencies attainable in the GPS and GLONASS band 210, as well as the frequencies attainable in the WiFi band 220. In the plot 200 of FIG. 2, the line 230 is representative of the GPS antenna structure 110, and the line 240 is representative of the WiFi antenna structure 160. Additionally, for these given ranges, the return loss values for the desirable frequencies are well below −9 dB, which is outstanding. As is clear from the plot 200, the return loss values for the desirable frequencies are actually well below about −12 dB, and even below about −18 dB in the WiFi band 220. Further illustrated in FIG. 2, is a line 250 representative of the isolation that exists for the antenna 100 of FIG. 1. As is clear, an isolation between the GPS antenna structure 110 and the WiFi antenna structure 160 at the 1575-1610 MHz GPS and GLONASS band 210 and the 2400-2480 MHz WiFi band 220 is at least about −12 dB. In fact, the isolation between the GPS antenna structure 110 and the WiFi antenna structure 160 at the 1575-1610 MHz GPS and GLONASS band 210 and the 2400-2480 MHz WiFi band 220 is at least about −15 dB. Moreover, isolation between the GPS antenna structure 110 and the WiFi antenna structure 160 at the 1575-1610 MHz GPS and GLONASS band 210 is at least about −24 dB. Furthermore, isolation between the GPS antenna structure 110 and the WiFi antenna structure 160 at the GPS only band (e.g. about 1575 MHz) is greater than about −40 dB.

Figure 3:
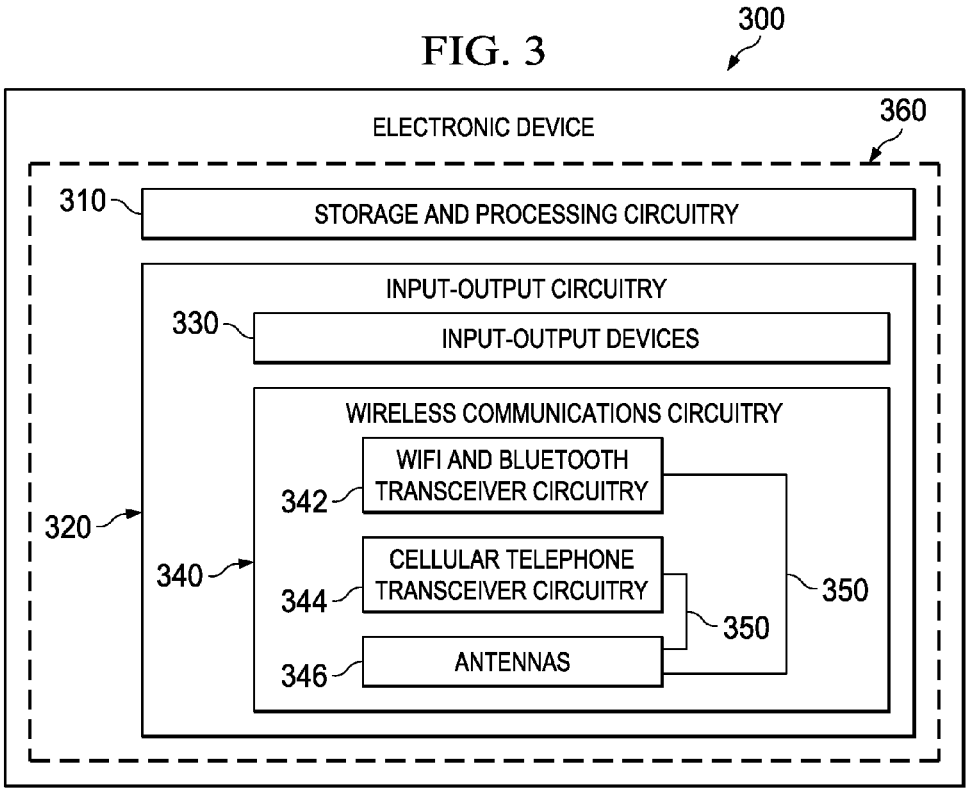
FIG. 3 illustrates a schematic diagram of electronic device in accordance with the disclosure.

FIG. 3 shows a schematic diagram of electronic device 300 manufactured in accordance with the disclosure. Electronic device 300 may be a portable device such as a mobile telephone, a mobile telephone with media player capabilities, a handheld computer, a remote control, a game player, a global positioning system (GPS) device, a laptop computer, a tablet computer, an ultraportable computer, a combination of such devices, or any other suitable portable electronic device.

As shown in FIG. 3, electronic device 300 may include storage and processing circuitry 310. Storage and processing circuitry 310 may include one or more different types of storage such as hard disk drive storage, nonvolatile memory (e.g., flash memory or other electrically-programmableread-only memory), volatile memory (e.g., static or dynamic random-access-memory), etc. Processing circuitry in the storage and processing circuitry 310 may be used to control the operation of device 300. The processing circuitry may be based on a processor such as a microprocessor or other suitable integrated circuits. With one suitable arrangement, storage and processing circuitry 310 may be used to run software on device 300, such as internet browsing applications, voice-over-internet-protocol (VOIP) telephone call applications, email applications, media playback applications, operating system functions, etc. Storage and processing circuitry 310 may be used in implementing suitable communications protocols.

Communications protocols that may be implemented using storage and processing circuitry 310 include, without limitation, internet protocols, wireless local area network protocols (e.g., IEEE 802.11 protocols—sometimes referred to as WiFi®), protocols for other short-range wireless communications links such as the Bluetooth® protocol, protocols for handling 3G communications services (e.g., using wide band code division multiple access techniques), 2G cellular telephone communications protocols, etc. Storage and processing circuitry 310 may implement protocols to communicate using 2G cellular telephone bands at 850 MHz, 900 MHz, 1800 MHz, and 1900 MHz (e.g., the main Global System for Mobile Communications or GSM cellular telephone bands) and may implement protocols for handling 3G and 4G communications services.

Input-output device circuitry 320 may be used to allow data to be supplied to device 300 and to allow data to be provided from device 300 to external devices. Input-output devices 330 such as touch screens and other user input interfaces are examples of input-output circuitry 320. Input-output devices 330 may also include user input-output devices such as buttons, joysticks, click wheels, scrolling wheels, touch pads, key pads, keyboards, microphones, cameras, etc. A user can control the operation of device 300 by supplying commands through such user input devices. Display and audio devices may be included in devices 330 such as liquid-crystal display (LCD) screens, light-emitting diodes (LEDs), organic light-emitting diodes (OLEDs), and other components that present visual information and status data. Display and audio components in input-output devices 330 may also include audio equipment such as speakers and other devices for creating sound. If desired, input-output devices 330 may contain audio-video interface equipment such as jacks and other connectors for external headphones and monitors.

Wireless communications circuitry 340 may include radio-frequency (RF) transceiver circuitry formed from one or more integrated circuits, power amplifier circuitry, low-noise input amplifiers, passive RF components, one or more antennas, and other circuitry for handling RF wireless signals. Wireless signals can also be sent using light (e.g., using infrared communications). Wireless communications circuitry 340 may include radio-frequency transceiver circuits for handling multiple radio-frequency communications bands. For example, circuitry 340 may include transceiver circuitry 342 that handles 2.4 GHz and 5 GHz bands for WiFi® (IEEE 802.11) communications and the 2.4 GHz Bluetooth® communications band. Circuitry 340 may also include cellular telephone transceiver circuitry 344 for handling wireless communications in cellular telephone bands such as the GSM bands at 850 MHz, 900 MHz, 1800 MHz, and 1900 MHz, as well as the UMTS, HSPA+ and LTE bands (as examples). Wireless communications circuitry 340 can include circuitry for other short-range and long-range wireless links if desired. For example, wireless communications circuitry 340 may include global positioning system (GPS) receiver equipment, wireless circuitry for receiving radio and television signals, paging circuits, etc. In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless communications circuitry 340 may include antennas 346. Device 300 may be provided with any suitable number of antennas. There may be, for example, one antenna, two antennas, three antennas, or more than three antennas, in device 300. For example, in one embodiment, at least one of the antennas 346 is similar to the antenna 100 discussed above with regard to FIG. 1, among others. In accordance with the disclosure, the antennas may handle communications over multiple communications bands. Different types of antennas may be used for different bands and combinations of bands. For example, it may be desirable to form a multi-band antenna for forming a local wireless link antenna, a multi-band antenna for handling cellular telephone communications bands, and a single band antenna for forming a global positioning system antenna (as examples).

Paths 350, such as transmission line paths, may be used to convey radio-frequency signals between transceivers 342 and 344, and antennas 346. Radio-frequency transceivers such as radio-frequency transceivers 342 and 344 may be implemented using one or more integrated circuits and associated components (e.g., power amplifiers, switching circuits, matching network components such as discrete inductors and capacitors, and integrated circuit filter networks, etc.). These devices may be mounted on any suitable mounting structures. With one suitable arrangement, transceiver integrated circuits may be mounted on a printed circuit board. Paths 350 may be used to interconnect the transceiver integrated circuits and other components on the printed circuit board with antenna structures in device 300. Paths 350 may include any suitable conductive pathways over which radio-frequency signals may be conveyed including transmission line path structures such as coaxial cables, microstrip transmission lines, etc.

The device 300 of FIG. 3 further includes a chassis 360. The chassis 360 may be used for mounting/supporting electronic components such as a battery, printed circuit boards containing integrated circuits and other electrical devices, etc. For example, in one embodiment, the chassis 360 positions and supports the storage and processing circuitry 310, and the input-output circuitry 320, including the input-output devices 330 and the wireless communications circuitry 340 (e.g., including the WiFi and Bluetooth transceiver circuitry 342, the cellular telephone circuitry 344, and the antennas 346.

The chassis 360, in one embodiment, is a metal chassis. For example, the chassis 360 may be made of various different metals, such as aluminum. Chassis 360 may be machined or cast out of a single piece of material, such as aluminum. Other methods, however, may additionally be used to form the chassis 360. In certain embodiments, the chassis 360 will couple to at least a portion of the antennas 346.

Those skilled in the art to which this application relates will appreciate that other and further additions, deletions, substitutions and modifications may be made to the described embodiments.

What is claimed is:

1. An antenna, comprising:

an inverted-F GPS antenna structure, the inverted-F GPS antenna structure embodying a first GPS feed element, a GPS extending arm, and a ground element; and a loop WiFi antenna structure, the loop WiFi antenna structure embodying a second different WiFi feed element, the ground element, and a WiFi connecting arm coupling the second different WiFi feed element to the ground element, wherein the ground element is located between the first GPS feed element and the second different WiFi feed element.

2. The antenna as recited in claim 1, wherein the GPS extending arm folds over at least a portion of the loop WiFi antenna structure.

3. The antenna as recited in claim 1, wherein the GPS extending arm folds over at least a portion of the WiFi connecting arm.

4. The antenna as recited in claim 3, wherein the GPS extending arm folds over the WiFi connecting arm by a distance (d) of at least about 5 mm.

5. The antenna as recited in claim 1, wherein the inverted-F GPS antenna structure and the loop WiFi antenna structure are formed from a single conductive element.

6. The antenna as recited in claim 1, wherein an isolation between the inverted-F GPS antenna structure and the loop WiFi antenna structure at a 1575-1610 MHz GPS band and a 2400-2480 MHz WiFi band is at least about −12 dB.

7. The antenna as recited in claim 1, wherein an isolation between the inverted-F GPS antenna structure and the loop WiFi antenna structure at a 1575-1610 MHz GPS and GLONASS band and a 2400-2480 MHz WiFi band is at least about −15 dB.

8. The antenna as recited in claim 7, wherein isolation between the inverted-F GPS antenna structure and the loop WiFi antenna structure at the 1575-1610 MHz GPS and GLONASS band is at least about −24 dB.

9. The antenna as recited in claim 1, wherein the loop WiFi antenna structure also functions as a Bluetooth antenna structure.

10. The antenna as recited in claim 1, wherein the inverted-F GPS antenna structure and the loop WiFi antenna structure are located within a volume of less than about 1.5 $cm^3$.

11. An electronic device, comprising:

storage and processing circuitry;

input-output devices associated with the storage and processing circuitry; and wireless communications circuitry including an antenna, the antenna including;

an inverted-F GPS antenna structure, the inverted-F GPS antenna structure embodying a first GPS feed element, a GPS extending arm, and a ground element; and a loop WiFi antenna structure, the loop WiFi antenna structure embodying a second different WiFi feed element, the ground element, and a WiFi connecting arm coupling the second different WiFi feed element to the ground element, wherein the ground element is located between the first GPS feed element and the second different WiFi feed element.

12. The electronic device as recited in claim 11, wherein the GPS extending arm folds over at least a portion of the loop WiFi antenna structure.

13. The electronic device as recited in claim 11, wherein the GPS extending arm folds over at least a portion of the WiFi connecting arm.

14. The electronic device as recited in claim 13, wherein the GPS extending arm folds over the WiFi connecting arm by a distance (d) of at least about 5 mm.

15. The electronic device as recited in claim 11, wherein the inverted-F GPS antenna structure and the loop WiFi antenna structure are formed from a single conductive element.

16. The electronic device as recited in claim 11, wherein an isolation between the inverted-F GPS antenna structure and the loop WiFi antenna structure at a 1575-1610 MHz GPS and GLONASS band and a 2400-2480 MHz WiFi band is at least about −12 dB.

17. The electronic device as recited in claim 11, wherein an isolation between the inverted-F GPS antenna structure and the loop WiFi antenna structure at a 1575-1610 MHz GPS and GLONASS band and a 2400-2480 MHz WiFi band is at least about −15 dB.

18. The electronic device as recited in claim 17, wherein isolation between the inverted-F GPS antenna structure and the loop WiFi antenna structure at the 1575-1610 MHz GPS band is at least about −24 dB.

19. The electronic device as recited in claim 11, wherein the inverted-F GPS antenna structure and the loop WiFi antenna structure are located within a volume of less than about 1.5 $cm^3$.

20. The electronic device of claim 11, wherein the storage and processing circuitry, input-output devices, and wireless communications circuitry are positioned within a conductive chassis, and further wherein the ground element electrically connects to the conductive chassis.

* * * * *